United States Patent [19]

Friend

[11] Patent Number: 4,795,305

[45] Date of Patent: Jan. 3, 1989

[54] CABLE OPERATED LOADER APPARATUS

[76] Inventor: Russell P. Friend, P.O. Box 3326, North Las Vegas, Nev. 89030

[21] Appl. No.: 126,210

[22] Filed: Nov. 27, 1987

[51] Int. Cl.[4] ..... E02F 3/42

[52] U.S. Cl. ..... 414/709; 414/706; 414/716

[58] Field of Search ..... 414/706, 707, 709, 716, 414/686, 551, 487, 697; 280/400; 298/1 C

[56] References Cited

U.S. PATENT DOCUMENTS

| | | | |
|---|---|---|---|
| 1,611,195 | 12/1926 | Jelen | 414/697 X |
| 2,119,139 | 5/1938 | Owen et al. | 414/551 X |
| 2,303,001 | 11/1942 | Ruddock | 414/716 |
| 2,330,041 | 9/1943 | Franke | 414/706 |
| 2,336,390 | 12/1943 | Boll | 414/709 |
| 2,371,273 | 3/1945 | Walker | 414/709 |
| 3,034,671 | 5/1962 | Schwellenbach | 414/707 X |
| 3,347,577 | 10/1967 | Carlson et al. | 280/400 X |
| 4,044,903 | 8/1977 | Baron | 414/706 X |
| 4,140,186 | 2/1979 | Stedman | 280/400 X |

FOREIGN PATENT DOCUMENTS 126749 7/1928 Switzerland .

*Primary Examiner*—Leslie J. Paperner

*Attorney, Agent, or Firm*—Seiler, Quirk & Tratos

[57] ABSTRACT

A portable bucket loader attachment can be operated by a conventional garden tractor or pickup truck. The loader has a wheel mounted frame having a forwardly extending boom carrying a bucket rotationally mounted at the end of the boom. A rotational control device mounted on the frame is operated by one or more cables which are operatively connected to a pair of electric winches. The rotational control device is connected to the bucket by connecting rods which control the rotational position of the bucket about the boom, thus controlling the "scoop" and "dump" functions of the bucket. Elevation of the bucket is controlled by a winch which retrieves and releases cable connected to the rotational control device, the cable also passing over a sheave mounted at an upper portion of the frame.

12 Claims, 4 Drawing Sheets

CABLE OPERATED LOADER APPARATUS

BACKGROUND OF THE INVENTION

This invention relates to a front-end bucket loader which is easily portable and which may be operated by attachment to a garden tractor or pickup truck. More particularly, the invention relates to a mechanical scoop actuated by winch-operated cables which is easily portable and easily operated, yet which has a high work capacity.

Bucket loaders, sometimes referred to as "front-end loaders", are frequently used in the construction industry for scooping dirt, rocks, or debris from a pile, and transferring the material held in the bucket to another location, e.g., to a dump truck. In general, bucket loaders are sizable, self-powered items of equipment, and are quite expensive to purchase and operate. In addition, because of the expense of purchasing a loader, it must be used frequently to justify its purchase. However, there are many small jobs in which a loader can be used for transferring dirt or debris from one location to another, but in which the use of a large loader is unnecessary. In many of these jobs, such as small construction jobs or farm related jobs, use of a loader is essential, but only for short time periods or to move small piles of material, thus not justifying the purchase or lease of a major piece of equipment. A need exists for a loader which can be attached to a simple garden tractor or pickup truck, yet which is capable of handling single loads in the 1,000–2,000 pound range.

The loader of the invention is mounted on a wheeled frame which is easily towed by attaching a conventional trailer hitch mounted on the frame to a tractor, pickup truck, or other vehicle. The loader can also be operated from the seat of these vehicles by means of a simple remote control switch which requires only four operating positions. Control of rotational attitude and vertical elevation of the bucket is powered by a self-contained 12 volt D.C. battery which powers two electrical cable winches. In a preferred embodiment, a single cable is operatively connected to a sheave mounted on a bucket-carrying boom, and the single cable controls all operations of the device. The apparatus of the invention provides a simple, inexpensive, easily manufactured bucket loader attachment operable by means of a four position electrical switch.

Cable-operated lift devices which attach to a tractor are shown in Spaeth, U.S. Pat. No. 2,367,150 and Ginder, U.S. Pat. No. 2,481,994. These devices are designed to lift light loads (e.g., hay), and do not have the scoop control features of the loader of the invention. A cable-operated backhoe is shown in Pehkonen, U.S. Pat. No. 2,837,220. These disclosures do not show a cable-actuated bucket loader of the type described herein.

Accordingly, it is an object of the invention to provide a scoop-type loading device which is easily portable by conventional small vehicles. It is another object of the invention to provide a bucket loader attachment which operates easily by means of two independent electrical cable winches. It is yet a further object of the invention to provide a bucket loader having a full load and dump cycle which can be easily effectuated by four switch movements. These and other objects of the invention will be apparent from the following detailed description of a preferred embodiment thereof.

BRIEF SUMMARY OF THE INVENTION

A loader attachment comprises a wheeled base having a mounting hitch for connecting to a motorized vehicle at a rear portion thereof. A frame mounted on the base carries a pivoted boom having a forward end thereof pivotally attached to a scoop or bucket. A pair of bucket attitude control arms are mounted to a rotatable control wheel carried by the boom. One or more cables operatively connected to a pair of electric winches mounted on the frame act on the control wheel. The cable from one winch is connected in a manner so as to primarily rotate the control wheel, while the cable from the other winch is operatively connected to elevate and lower the boom.

BRIEF DESCRIPTION OF THE DRAWINGS

The invention is best understood with reference to the drawings, in which.

DETAILED DESCRIPTION OF A PREFERRED EMBODIMENT

Figure 1:
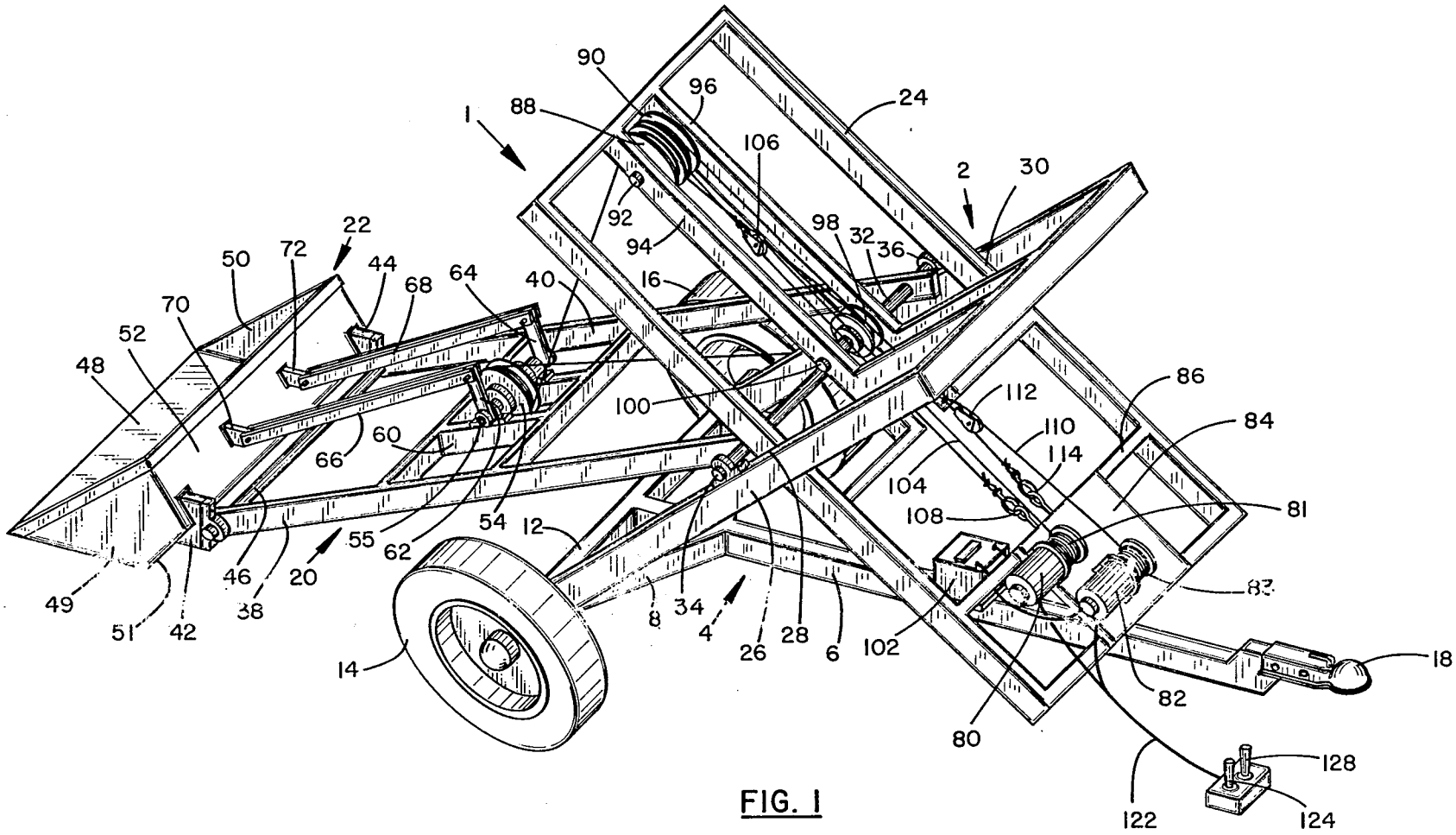
FIG. 1 is a perspective view of the loader attachment of the invention.

Referring first to FIG. 1, which is a perspective view of the loader attachment of the invention, the loader 1 has a rigid frame 2 having a base frame portion 4 which supports the entire apparatus. The base 4 has an elongate longitudinal member 6 having a conventional ball-joint trailer hitch 18 at a rear end thereof. At the forward end of base 4 are a pair of divergent struts 8 and 10 which are strengthening members which connect member 6 to the ends of a transverse axle 12. Wheels 14 and 16 are mounted on the ends of axle 12 to provide easy maneuverability and transportation of the loader attachment. As is apparent from the drawings, the wheel axle is located in or near the plane of the center of gravity of the device, thus allowing the wheel (rather than the hitch) to bear the weight and torque of the machine.

A boom 20 having bucket 22 mounted at its forward end is pivotally mounted to the frame at a central portion thereof. The frame consists of two rectangular frame sections 24 and 26 which are fixed to, and extend upwardly from, base frame portion 4. Frame segment 24 extends upwardly and forwardly from longitudinal base member 6, and frame segment 26 extends rearwardly and upwardly from axle 12. Frame segments 24 and 26 are welded together at their intersections 28 and 30. The two frame segments each extend at angles of about 45° to the base, thus forming approximately a 90° angle between the sections. The boom arms 38 and 40, which converge slightly toward the bucket, are forwardly extending steel bars and are pivotally mounted on boom mount 32, which is a cylindrical rod mounted transversely across the frame. The rod extends through arms 38 and 40, and is fixed to the frame in bearing mounts 34 and 36 which are permanently fastened to frame member 26.

The bucket is pivotally mounted around a horizontal axis at the forward end of the boom by means of a pair of mounting lugs 42 and 44. Each of the mounting lugs has a transverse opening into which a cylindrical mounting bar 46 is journalled. The bucket is of conventional design, having a flat ground-engaging bottom wall 48 which acts as a scoop, side walls 49 and 50, rear wall 51, and top wall 52. As the bucket is rotated rearwardly to lift the load, rear wall 51 assumes a position horizontal to the ground and effectively becomes the bottom wall of the bucket. The particular bucket design is not critical to the invention, and other scoop type devices can be used; for example, a platform for fork-type lift fabricated from a plurality of tines may also be used.

The most important part of the invention is the bucket control assembly, which lifts and rotates the bucket in a manner necessary for most loading operations. Elevation and rotation of the bucket is effected by two electric winches 80 and 82 mounted on the frame and which control cables operatively connected to an anchor or control sheave 54 mounted on the boom. Control sheave 54 is of 8" diameter and is freely rotatable about axle 55 which is retained by bearing assemblies 56 and 58 mounted on sheave mounting frame 60. The mounting frame 60 consists of a first pair of parallel struts extending between boom arms 38 and 40, and a second pair of parallel struts connecting the first pair.

The control sheave is the heart of the bucket attachment of the invention, and controls both the vertical height and rotational orientation of the bucket. The bucket rotational orientation is controlled directly by rotation of sheave 54. The sheave is fixed to rotate with axle 55, thereby rotating lever arms 62 and 64 which are short steel bars also fixed to rotate with the axle and sheave. The outer end of the lever arms 62 and 64 are pivotally mounted to a pair of elongate connecting rods or linkages 66 and 68. The forward end of the connecting rods 66 and 68 are pivotally mounted to a pair of spaced mounting ears or lugs 70 and 72 attached to the exterior of bucket wall 52. Accordingly, the attitude control mechanism for the bucket is effectively a reciprocating crank, wherein the connecting rods 66 and 68 are moved forwardly and rearwardly by the control sheave, thereby causing the bucket to pivot about its mounting rod 46. The reciprocating control rotates a maximum of less than 180°, generally not more than 135°.

The actuation mechanism for the control sheave is simple yet extremely effective. The control sheave is actuated by a pair of electrical winches operated by a conventional 12 volt D.C. battery 102. If desired, the winches can be connected directly to the electrical system of the power vehicle (e.g., truck or tractor). The winches 80 and 82 are commercially available, for example Superwinch model X-2 manufactured by Superwinch of Putnam, Connecticut. The winches have spool portions 81 and 83, respectively, for retaining wrapped cable. The winches are mounted on a plate 84 spanning the lower end of frame section 24 and a transverse mounting brace 86. The control sheave 54 is operatively attached to each winch through a single cable 116, which is ¼" wire rope. Cable extends from a first winch 80 over a 6" freely rotatable point sheave 88, around the control sheave 54, under freeably rotatable guide sheave 98, over second point sheave 90, and to winch 82. The cable makes approximately a 1¾ wrap around the control sheave. For mechanical advantage, cable 116 is attached to the first winch 80 by means of a short cable segment 104 which threads through pulley 106 and is fixed to the mounting strut 86 by means of a linked eye bolt attachment 108. The end of main cable 116 is attached to pulley 106. Similarly, the other end of main cable 116 is attached to pulley 112. A short cable 110 which extends from the spool 83 of winch 82 threads through the pulley 112 and is attached at its other end to linked eye bolts 114. The eye bolts 108 and 114 are permanently fastened to strut 86.

Figure 3:
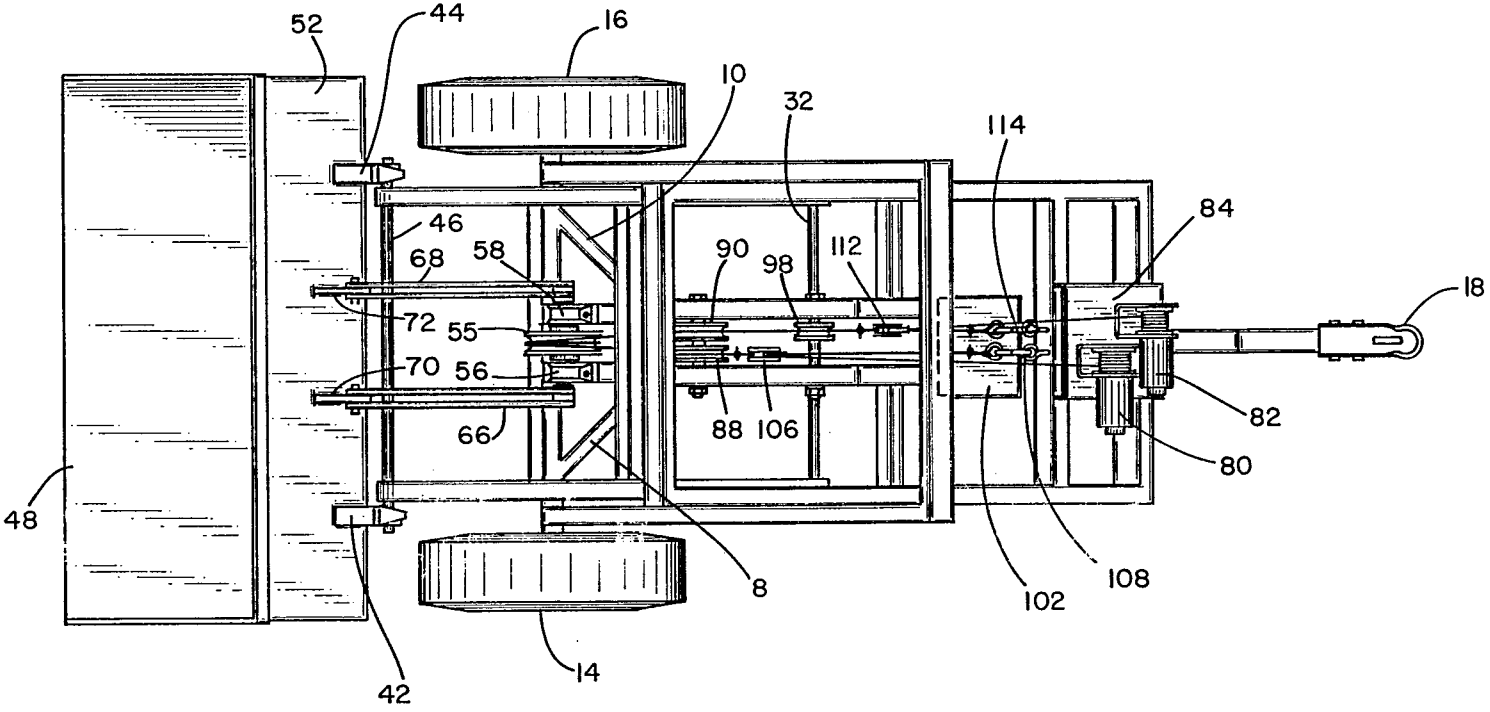
FIG. 3 is a top plan view thereof.

Sheaves 88, 90, and 98 are freely rotatable and are mounted in frame member 24 to act as cable guides. Point sheaves 88 and 90 are coaxially mounted on axle 92 which extends between parallel point sheave mounting bars 94 and 96. These bars are fastened to the frame portion 24 and serve to provide a mounting bracket for the cable guide sheaves. Similarly, guide sheave 98 is freely rotatable about axle 100, which is also mounted between the sheave mount bars 94 and 96. As is seen in FIG. 3, guide sheave 98 and point sheave 90 are located in the same vertical plane, while control sheave 54 is located in a vertical plane intermediate the planes of rotation of point sheaves 88 and 90. By adjustment of the specific location of the guide sheave and point sheave, along the frame, the bucket may be exactly self-leveling upon elevation.

Threading of the main cable is of course very important to obtain the desired movement of the boom and the bucket. The main cable 116, which is operatively connected to winch 80 through pulley 106, extends from pulley 106 over the top of point sheave 88, and downwardly and forwardly to the bottom of control sheave 54. The cable makes 1¾ turns around the control sheave, departing the top portion of the sheave rearwardly to guide sheave 98. The cable extends under the guide sheave, thence upwardly to the forward portion of point sheave 90, around point sheave 90 and downwardly to pulley 112. It should be recognized that the specific cable threading can be varied with differing frame structure, for example, the frame could be configured such that the cable passing from control sheave 54 over guide sheave 98 could extend directly to the winch. In addition, depending on the winch power, frame construction, and load lift criteria, the pulleys used to obtain mechanical advantage may be either eliminated or increased in number.

The term "cable" or "cable means" refers to any flexible load-bearing means, which may be wire or plastic rope, chain, or the like, which may be retrieved and released on a spool or equipment. The term "winch" is likewise intended to refer to any rotatable mechanism for retrieving and releasing cable.

The winches may be actuated either manually by switches which exist on the winches, or remotely by means of remote switches 124 and 128 electrically attached to the winches by means of cable 122. Switches 124 and 128 are conventional three-position switches, with a vertical position representing "off", and the forward and rearward positions representing respectively "cable release" and "cable retrieve". The switch handles are spring biased toward the neutral or "off" position. By using the remote actuating switch, a user can sit in a pickup or on the seat of a garden tractor and operate the bucket attachment quickly and easily by simply moving the switches from that location.

Figure 2:
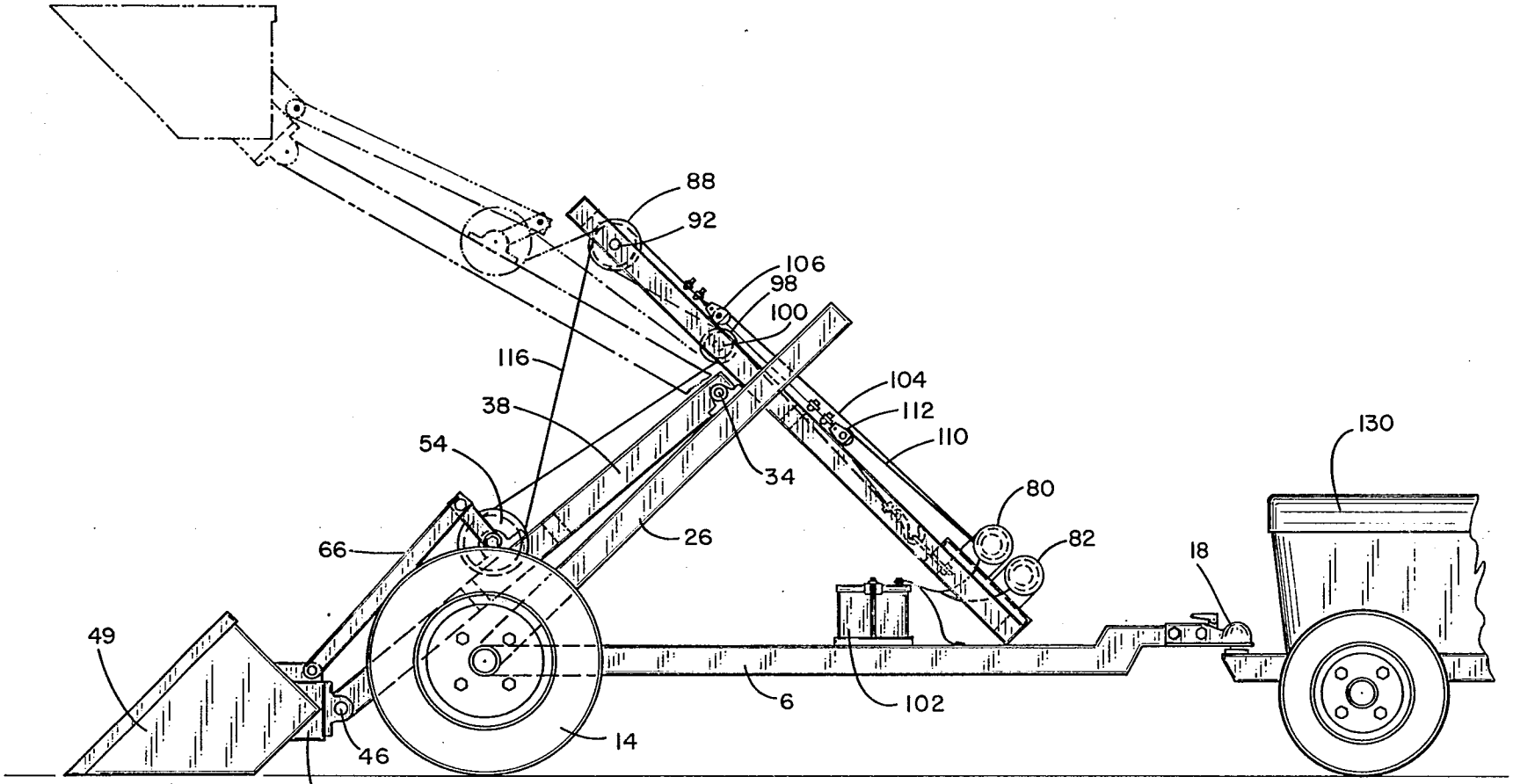
FIG. 2 is a side view thereof showing the loader attached to a tractor and showing the bucket in both raised and lowered positions.
Figure 4:
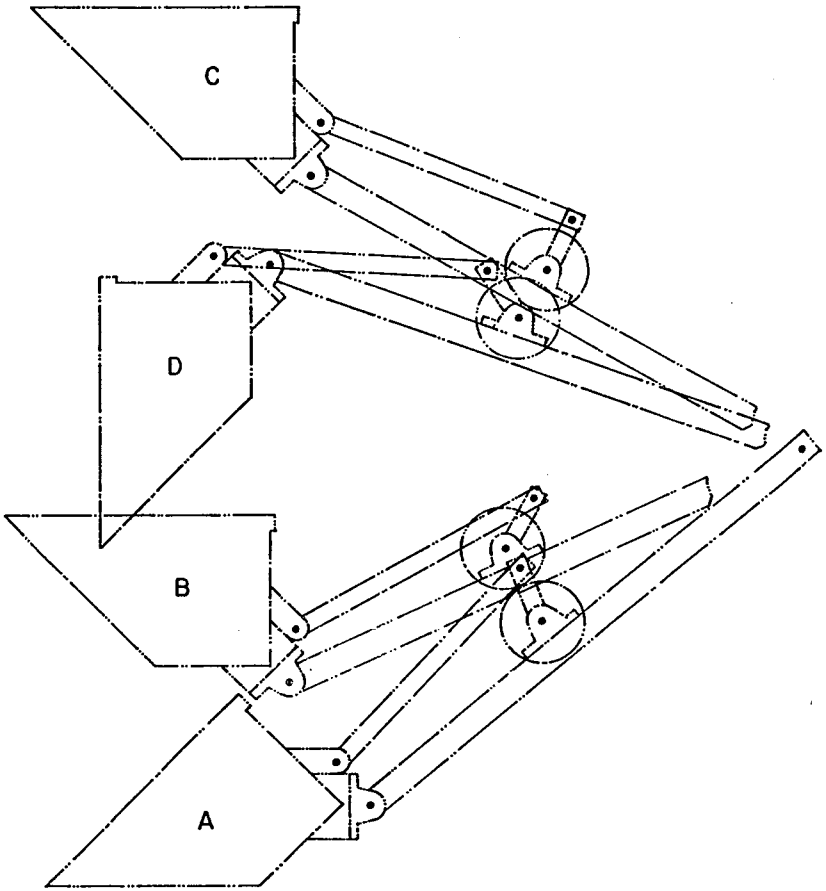
FIG. 4 is a schematic diagram showing a complete load, lift, and dump cycle of the loader.

FIG. 2 shows a side view of the attachment with the hitch 18 mounted on the front of a garden tractor 130. This drawing shows a detailed depiction of the loader apparatus in the "load" mode, and, in phantom, with the bucket raised in a level position ready to dump. Basically, the entire operation of the loader is a four-step procedure, shown schematically in FIG. 4. The entire operation is effected by means of four sequential switch operations; only one switch need be operated for each step. Procedurally, use of the loader begins with the apparatus in the configuration shown in FIG. 2 and in position "A" of FIG. 4. The bucket is prepared for moving forward into a pile of dirt or debris, with the bucket acting as a scoop and the material being forced into the rear portion of the bucket. When the bucket has been pushed into the load, the bucket is moved from position "A" to position "B" (as shown in FIG. 4) by retrieving cable on winch 82. This causes a rearward (i.e., clockwise in FIG. 2) rotation of control sheave 54, rotating the lever arms 62 and 64 in a rearward direction and causing a concomitant rearward rotation of the bucket 22 around bucket mount 46. Cable is retrieved on winch 82 until the bucket tips slightly rearwardly of horizontal, thereby allowing the contents to settle toward the back of the bucket to prevent spillage. As the rearward rotation of the bucket is being effected by winch 82, the boom elevates slightly since retrieval of cable results in a slight shortening of the cable segment between the control sheave and point sheave 88, causing the boom to "climb" slightly along this cable.

The load may be carried with the loader in position "B" to a dump location. If the load is to be dumped into a hopper, such as a dump truck, the boom is elevated from position "B" to position "C" (also shown in FIG. 2 in phantom) by retrieving cable on winch 80. With winch 82 being inactive, retrieval of cable on winch 80 creates an upward force on the cable 116 between the control sheave 54 and point sheave 88, thereby elevating the boom by pivoting around mounting bar 32. An extremely important feature of the invention is that with the design as shown in the drawings, the bucket maintains a self-leveling orientation between positions "B" and "C" as shown in FIG. 4. As cable is being retrieved on winch 80, the boom elevates and the control sheave 54 naturally undergoes a slight forward rotation, which maintains the bucket in a level horizontal position during the entire travel of the bucket from position "B" to position "C". This self-leveling feature is inherent in the design of the loader attachment, and does not require that the operator adjust both winches during the travel of the bucket from position "B" to position "C". In other words, for an operator to move the loader from position "A" to position "C", he need only retrieve cable on winch 82 until position "B" is attained, and then retrieve cable on winch 80 until position "C" is reached.

To dump the load from position "C" and reach position "D", the operator need only release cable on winch 82. The lever arms 62 and 64 rotate forwardly as cable is released, moving the connecting rods 66 and 68 forwardly and pivoting the bucket downwardly into position "D". At the same time, since release of the cable from winch 82 causes a slight forward rotation of the control sheave, the boom lowers slightly thereby assisting in removing the contents from the bucket during the dump cycle. When the dump is complete, the boom is lowered by releasing cable on winch 80, thereby returning the bucket to position "A". The apparatus can be transported from the pickup location to the dump location in virtually any bucket attitude above ground, since the operator's visibility is very good because the frame is constructed so as not to obstruct the operator's vision.

Accordingly, the advantage of using the loader attachment of the invention is readily apparent since the operation is extremely simple. The entire cycle can be accomplished by moving the control switch into each of four different switch positions one time only. In addition, each position may be used sequentially, and it is not necessary to continually adjust the rotational attitude of the bucket and the height of the bucket during its operation. Each switch needs to be used only once. This provides a substantial advantage in terms of ease of operation, and enables a faster cycle than other more complex and larger machines. Although the loader apparatus of the invention is relatively simple and inexpensive to build and operate, loads in excess of 2,500 pounds are easily lifted and moved with the device heretofore described. In addition, since the apparatus is non-hydraulic, maintenance is low and service is easily accomplished. Though heavy duty, the device is easily transported by a pickup truck by connecting the trailer hitch to the back of the pickup. The weight of the machine is balanced generally over the wheels, and the hitch is easily raised and lowered with little effort. When used with a pickup truck, the apparatus is towed by means of a hitch at the rear of the truck, and operated by a hitch at the front of the truck.

Although the invention has been described with respect to an attachment which easily mounts on a power vehicle, it can also be designed as part of a self-driven apparatus. One skilled in the art can easily adapt the bucket-operating mechanism to a self-powered base, in a manner similar to small self-powered bucket loaders or fork lifts.

While the invention has been described with respect to a specific embodiment thereof, it will be immediately apparent to those skilled in the art that modifications may be made within the spirit and scope of the invention. The most important feature of the invention is the cable attachment to a rotational control element, which has been shown as the control sheave 54. It would of course be possible to have two separate control sheaves, with cable from each winch being operably connected to one of the sheaves, with the cable being partially wrapped around the sheave and the end of the cable being attached thereto permanently. This arrangement would permit the same reciprocating rotational motion of the axle 55 as occurs with a single sheave being attached to cable from both winches. Accordingly, the invention should not be limited with respect to the specific embodiment disclosed herein, but rather should be defined only by the following claims.

I claim:

1. Portable loading apparatus comprising a base, a frame mounted on the base and extending upwardly therefrom, boom means pivotally mounted on the frame and extending forwardly therefrom, said boom means being movable between a lowered loading position and an elevated dumping position, scoop means pivotally mounted at a forward end portion of the boom means, scoop control means for selectively controlling the rotational position of the scoop means comprising control sheave means rotatably mounted on the boom means at a forward location thereon, first cable actuating means for releasing and retracting cable means, second cable actuating means for releasing and retracting cable means, said first and second cable actuating means being independently operable, first cable means operatively connected to the scoop control means and the first cable actuating means such that retraction of said first cable means by the first cable actuating means acts simultaneously to rotate the scoop control means in a first rotational direction and to raise the boom means toward the elevated dumping position, second cable means operatively connected to the scoop control means and the second cable actuating means such that retraction of said second cable means by the second cable actuating means acts to rotate the scoop control means in a second rotational direction opposite said first rotational direction.

2. The portable loading apparatus of claim 1 wherein the first and second cable actuating means are electrically powered winches, and the apparatus also comprises electrical power supply means electrically connected to the winches.

3. The portable loading apparatus of claim 1 also comprising attachment means for connecting a rear portion of the apparatus to a front portion of a motorized vehicle.

4. The portable loading apparatus of claim 1 wherein the scoop means comprises a bucket.

5. The portable loading apparatus of claim 1 also comprising a linkage connecting the control sheave means and the scoop means such that rotation of the control sheave means rotates the scoop means about a horizontal axis.

6. The portable loading apparatus of claim 5 wherein the linkage comprises at least one rigid rod pivotally connected to the scoop means.

7. The portable loading apparatus of claim 5 wherein the linkage comprises an arm having an end portion fixed to the scoop control means, and also comprises a rigid rod having one end portion pivotally attached to the arm, and an opposite end portion pivotally attached to the scoop means.

8. The portable loading apparatus of claim 7 wherein the linkage comprises first and second spaced parallel arms fixed to the scoop control means, and first and second rigid rods pivotally attached to the first and second arms and to the scoop means.

9. The portable loading apparatus of claim 1 also comprising at least two wheels transversely spaced and mounted on the base.

10. The portable loading apparatus of claim 1 wherein the first and second cable means comprises a single cable operatively connected to each of the first and second cable actuating means.

11. Portable loading apparatus comprises a base, wheels mounted on the base for supporting and transporting the apparatus, a frame mounted on the base and extending upwardly therefrom, boom means pivotally mounted about a horizontal axis on the frame and extending forwardly therefrom, a bucket pivotally mounted about a horizontal axis at a forward portion of the boom, bucket control means mounted on the boom means for selectively controlling the rotational position of the bucket, said bucket control means including a sheave means rotatable about a horizontal axis and a mechanical linkage extending from the sheave means to the bucket, a cable operatively connected to the bucket control means, first which means operatively connected to the cable such that retraction of the cable by the first winch means moves the boom in a vertical plane and rotates the sheave means in a first direction, second winch means operatively connected to the cable such that retraction of the cable by the first winch means rotates the sheave means in a direction opposite to the first direction, and an electrical power source electrically connected to the first and second winch means.

12. The portable loading apparatus of claim 11, wherein the bucket control means also comprises a cable actuated reciprocating control element, a reciprocating arm connected to the control element, and a rigid linkage pivotally connected to the bucket and to the arm.

* * * * *